United States Patent [19]

Higgins

[11] Patent Number: 4,864,664

[45] Date of Patent: Sep. 12, 1989

[54] VENT SYSTEM

[76] Inventor: Dale C. Higgins, 4817 Lake Louise, Metairie, La. 70006

[21] Appl. No.: 254,784

[22] Filed: Oct. 7, 1988

[51] Int. Cl.[4] ..... E03D 9/05

[52] U.S. Cl. ..... 4/213

[58] Field of Search ..... 4/213, 216, 217

[56] References Cited

U.S. PATENT DOCUMENTS

| | | | |
|---|---|---|---|
| 1,931,052 | 10/1933 | Baither | 4/213 |
| 2,058,436 | 10/1936 | Friel | 4/213 |
| 2,227,920 | 1/1941 | Baither | 4/213 |
| 2,297,935 | 10/1942 | Baither | 4/213 |
| 2,985,890 | 5/1961 | Baither | 4/213 |
| 4,222,129 | 9/1980 | Baker | 4/213 |
| 4,318,192 | 3/1982 | Williams et al. | 4/213 |
| 4,800,596 | 1/1989 | Menge | 4/213 |

*Primary Examiner*—Charles E. Phillips

*Attorney, Agent, or Firm*—Nies, Webner, Kurz & Bergert

[57] ABSTRACT

A ventilated toilet having a unique air duct and water trap system which results in improved ventilation for removing air contaminated with objectionable odors directly to a sewer line is disclosed. The toilet bowl and tank have built in air systems and the toilet seat is hollow and forms part of the air system. The fan and electrical components are located at the highest level of the fan-duct system so that water entering the air system due to tank overflow or a leak in the system will run out through the duct system before reaching the electrical components. The present system provides a water trap-/air vent combination which does not rely on running water to refill the trap.

5 Claims, 3 Drawing Sheets

FIG. 3
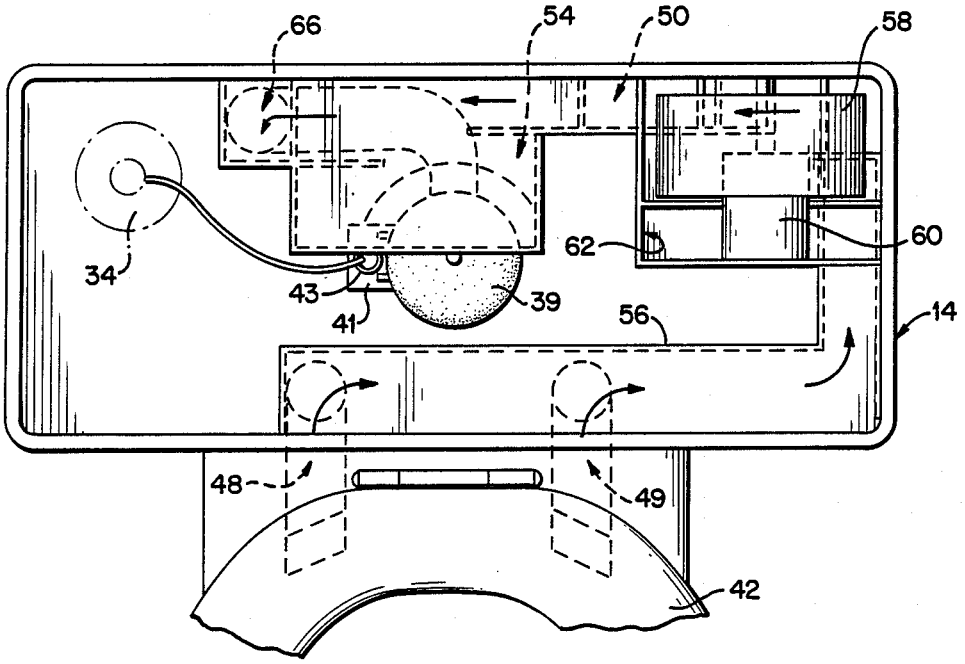
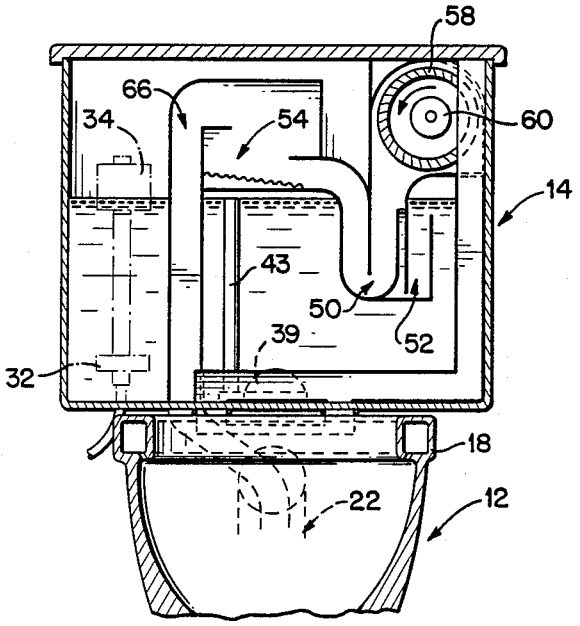
FIG. 4
FIG. 5
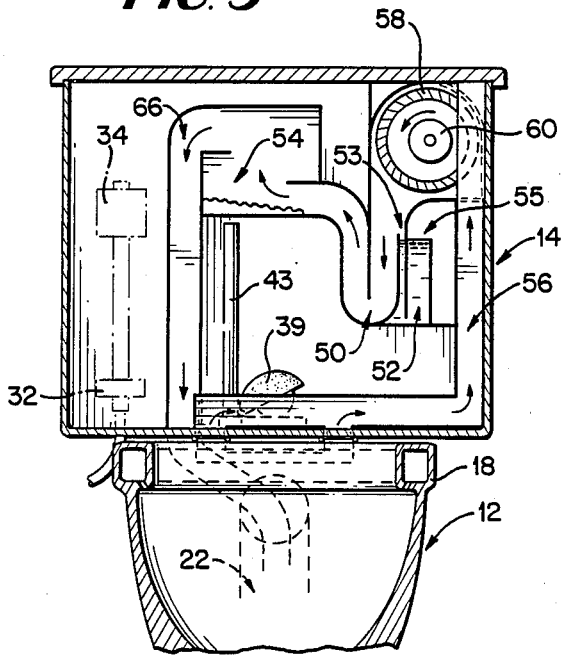

VENT SYSTEM

BACKGROUND AND SUMMARY OF THE INVENTION

The present invention relates to a vent system and, more particularly, to a ventilated toilet having a unique air duct and water trap system which results in improved ventilation for removing air contaminated with objectionable odors directly to a sewer line.

Previous ventilation systems for toilets and similar apparatus are described, for example, in the following U.S. Pat Nos.: 2,126,131 to Orebaugh; 2,227,920 to Baither; 2,297,935 to Baither; 2,985,890 to Baither; 3,916,459 to Ivancevic; and 4,318,192 to Williams et al.

By the present invention, there is provided an improved ventilation system for a toilet in which the toilet bowl and tank have built in air systems and in which the toilet seat is hollow and forms part of the air system. In the present ventilation system, electric power and the fan are located at the highest level of the fan-duct system so that water entering the air system due to tank overflow or a leak in the system will run out through the duct system before reaching the electrical components. In the present system, there is provided a water trap/air vent combination that does not rely on running water to refill the trap.

BRIEF DESCRIPTION OF THE DRAWINGS

FIG. 3 is a top plan view of a portion of the ventilation system of FIG. 1.

FIGS. 4 and 5 are front elevations of the ventilation system of FIG. 1, showing the system before and after the system is flushed.

DESCRIPTION OF THE PREFERRED EMBODIMENTS

Figure 1:
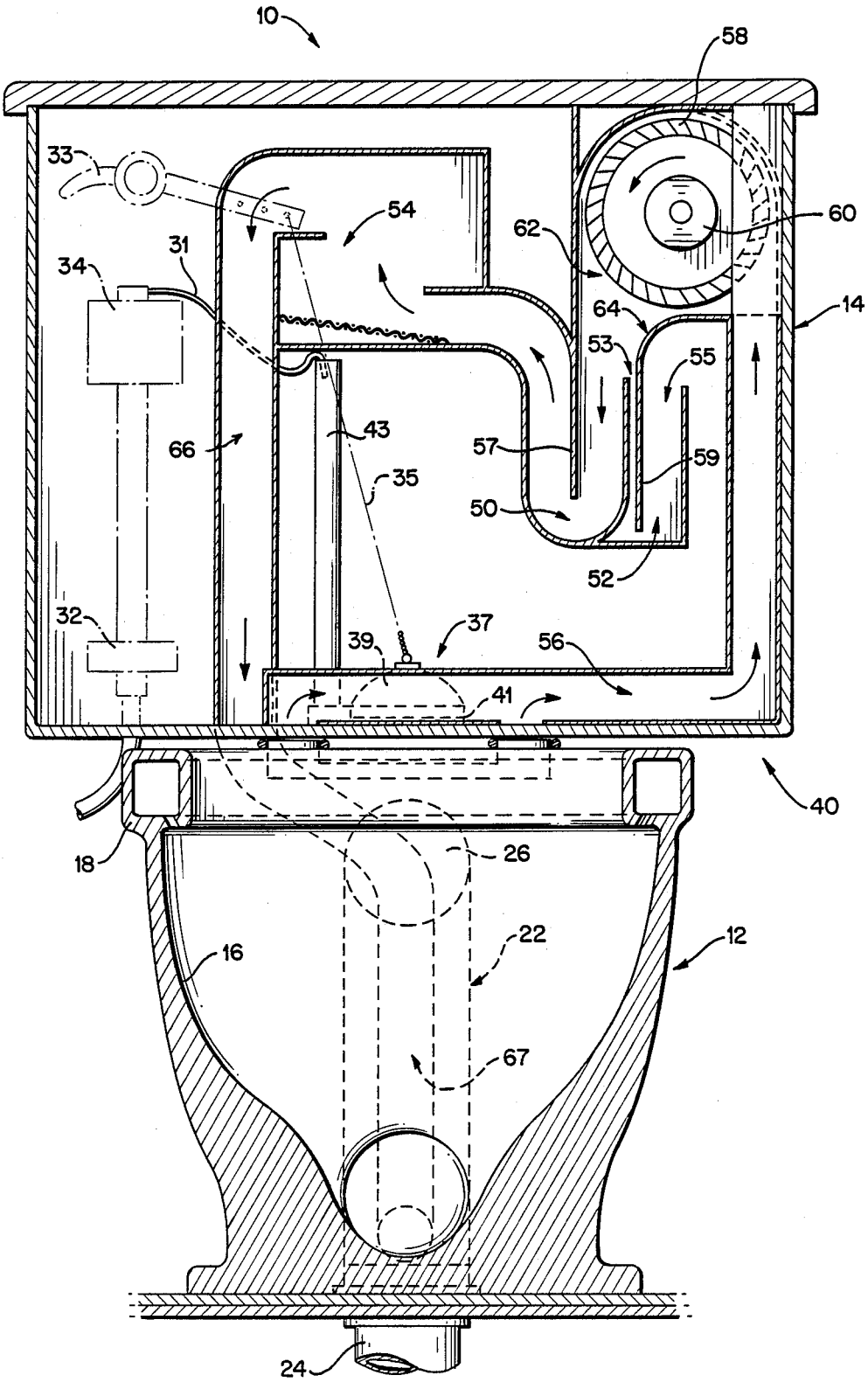
FIG. 1 is a front elevation of the ventilation system for a toilet in accordance with the present invention.

In the embodiment of the present invention as shown in FIGS. 1 through 5, there is provided a toilet 10 having a toilet stool 12 and holding tank 14. The stool 12 includes a toilet bowl 16 having a flush ring 18 formed at the upper end. The flush ring 18 is provided with a plurality of openings 20 which communicate with the upper end of the bowl 16 and allow fresh water to be flushed into the bowl 16 from flush ring 18.

The bottom of the toilet bowl 16 opens into a conventional internal waste discharge duct 22 which in turn is connected at its discharge end to a sewer pipe 24. The waste discharge duct 22 includes a conventional siphon portion 26 positioned behind the toilet bowl 16 and below the holding tank 14. A duct 66 also communicates with the lower end of discharge duct 22 as described hereinafter.

The flush ring 18 in the upper end of the toilet bowl 16 is connected to a water feed conduit 28 extending rearwardly under the holding tank 14.

The holding tank 14 may be manufactured separately from the toilet stool 12, there being a tank discharge outlet 30 in the bottom of the holding tank 14 which is centered on the water feed conduit 28.

The holding tank 14 includes a water intake valve 32 and a valve float 34 which operate in a conventional manner to refill the holding tank 14 and the toilet bowl 16 with fresh water after each flushing cycle. A handle 33 on the exterior of the tank 14 is connected by a chain 35 with a flapper valve 37 including flapper 39 which is cooperably mated to its associated flapper valve opening 41. The flapper valve 37 operates in a conventional manner to control the discharge of water from the holding tank 14 into the toilet bowl 16 through conduit 28. An overflow pipe 43 operates in a conventional manner in the event of high water conditions within the tank 14. A water supply tube 31 allows water to be passed into the overflow pipe 43.

The toilet 10 further includes a trap and vent assembly 40 having a seat 42 which is formed in an annular shape with a channel 44 formed in the seat 42 around the circumference thereof as part of the air system. A plurality of openings 46 are located on the underside of the seat 42 to allow air to enter the channel 44 when the assembly 40 is activated and thus draw contaminated air into channel 44. The openings 46 are spaced at intervals such as about an inch around the underside of the seat 42. In one embodiment the openings 46 had a diameter of about ¼ to ½ inch.

Figure 2:
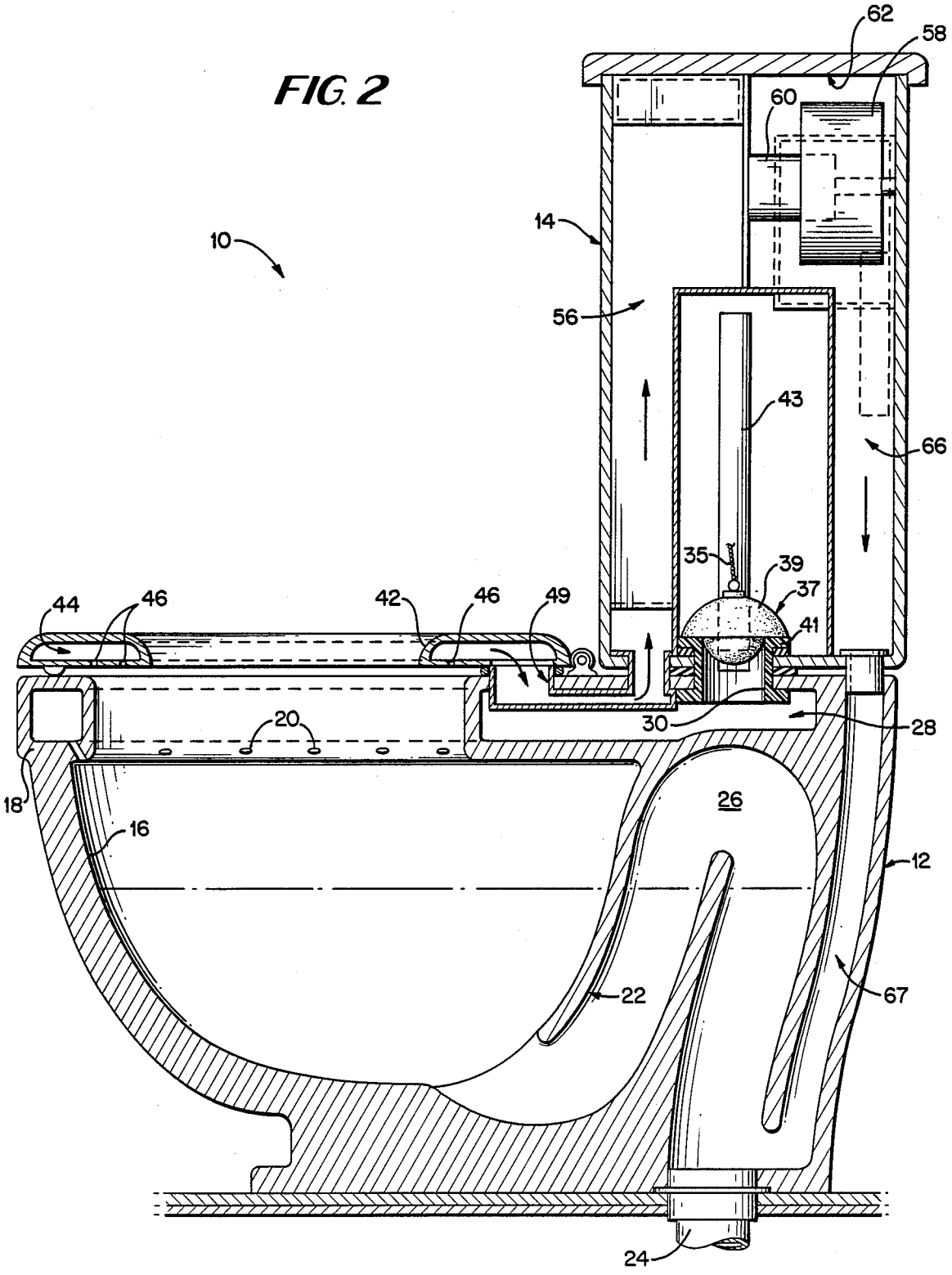
FIG. 2 is a side elevation of the ventilation system of FIG. 1.

The air drawn into the channel 44 will exit the channel 44 through a pair of conduits 48, 49 at the rear of the seat 42. In an alternative embodiment, only one conduit 49 is employed and conduit 48 is not utilized. As shown in FIG. 2, the opening from the channel 44 into the conduits 48 and 49 is raised to prevent water entering the air duct if the toilet bowl 16 overflows. The connection of the conduits 48, 49 to the rear of the seat 42 may be provided with hard rubber seals to prohibit air loss and make a firm connection.

The ducts 48, 49 communicate with a common duct 56 which passes upwardly to the top of the holding tank 14. A fan 58 and fan motor 60 are mounted in a chamber 62 at the upper end of duct 56. From chamber 62 a duct 64 passes downwardly to communicate with traps 50 and 52. As shown in FIG. 1, plate member 57 extends downwardly into the interior of trap 50 and plate member 59 extends downwardly into the interior of trap 52. A chamber 54 communicates directly with the upper end of trap 50. From chamber 54 a duct 66 communicates directly with the discharge end of duct 22 and sewer pipe 24 through lower duct 67, as shown in FIG. 2. By thus connecting the duct 66, siphoning is not hampered such as might occur if duct 66 were connected to the upper end of duct 22.

In the operation of the present vent system, when power is turned on to activate the fan motor 60, air enters the system by way of openings 46 strategically spaced on the underside of the seat 42. Since the seat 42 is hollow, air flows through the seat 42, exiting from the seat through ducts 48, 49 adjacent the connection of seat 42 and bowl 16. Air then flows through the duct 56 and on through trap 50 in the holding tank 14. Air does not flow through trap 52 due to the smaller diameter of the air intake 53 of trap 52 compared to the column of water 55 on the right. When the vent system is activated, the water level in trap 52 remains virtually unchanged. If this were not the case, foul air would blow into the back of the toilet.

Prior to turning on the power, there is at least a two inch water level in traps 50 and 52. Trap 50 serves as the "trap seal" when power is off and as an air duct when power is on. Trap 50 is clear of water when power is on, as shown in FIG. 4. Trap 52 serves as a water supply passage when power is off and as an air block when power is on.

Chamber 54 separates water and air exiting trap 50. During the power on operation, water from trap 50 is blown into chamber 54 and falls to the bottom of the chamber 54. The air flows freely up and out the top opening in the chamber 54. When power is on, all water in trap 50 exits. The air pressure exerted on the trap 52 opening prevents water from entering trap 50. On the other hand, the larger column 55 of water in the right side of trap 52 prevents the air from blowing through. The present system works before, during and after flushing the toilet. Air exits from the chamber 54 through ducts 66, 67 and 22 connected to the sewer line 24.

The present ventilation system discharges air by way of a trap seal 50 with minimal loss of water due to evaporation. Loss of water is replenished during each flush when the tank fills via trap 52. Raising or lowering the lower end of trap 52 relative to trap 50 will change the pressure balance. In one embodiment, the lower end of trap 52 was lower than the lower end of trap 50.

The present ventilation system will hold a two inch seal level (minimum plumbing code) even without a water replenishing source. Testing of the present system has shown that it would take 40 minutes of continued operation to evaporate enough water to drop below the two inch requirement. Therefore, in practical use, if the toilet was flushed and the water supply was off, the system would not be used again until water was restored. In other words, the fan would not be used if there were no water supply, hence no evaporation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A ventilation system for a toilet comprising:

a toilet stool and a toilet holding tank, said toilet stool having a therein a toilet bowl with a seat member connected to said toilet stool adjacent the upper end thereof, fan means mounted in a fan chamber within said holding tank, said chamber having an inlet and an outlet, first duct means for passage of air from said bowl to said fan means, a first trap member mounted in said holding tank in communication with said outlet, downstream of said fan means, a second trap member adjacent said first trap member with one end of said second trap in communication with water in said holding tank and the other end in communication with said first trap such that said water, at a normal operating level in said tank, will enter said first trap via said second trap to provide a seal for said first trap, a second chamber mounted in said holding tank in direct fluid communication with the downstream end of said first trap, said second chamber receiving said water which passes into said first trap when said fan means is operating, and second duct means for passage of air from said second chamber for disposal exterior to said toilet.

2. The ventilation system of claim 1 wherein the seat member is provided with openings in the underside of the seat.

3. The ventilation system of claim 1 wherein said first duct means includes an air passage from the seat member which is raised above the bowl to prevent water intake into said first duct means during bowl overflow.

4. The ventilation system of claim 1 wherein said fan means is mounted in the upper portion of said holding tank at the highest level so that water entering air passages in said ventilation system during holding tank overflow or leakage will run out through said second duct means before reaching electrical components.

5. The ventilation system of claim 1 wherein said first and second traps are in fluid communication with each other, said first and second traps being arranged in side by side relationship, and with first and second vertical plate members each extending from an upwardly secured position into a respective one of said first and second trap members.

* * * * *